US005714973A

United States Patent [19]

Takahashi et al.

[11] Patent Number: 5,714,973

[45] Date of Patent: Feb. 3, 1998

[54] DOCUMENT DISPLAY DEVICE

[75] Inventors: Yutaka Takahashi; Shinichi Shidara, both of Tokyo, Japan

[73] Assignee: Fuji Photo Film Co., Ltd., Kanagawa, Japan

[21] Appl. No.: 754,748

[22] Filed: Nov. 21, 1996

Related U.S. Application Data

[63] Continuation of Ser. No. 123,067, Sep. 17, 1993, abandoned.

[30] Foreign Application Priority Data

Sep. 18, 1992 [JP] Japan ..... 4-273447

[51] Int. Cl.[6] ..... G09G 5/34

[52] U.S. Cl. ..... 345/126; 345/127

[58] Field of Search ..... 345/126, 115, 345/113, 112, 117, 141, 127; 382/296, 297, 298; 395/137, 138, 139

[56] References Cited

U.S. PATENT DOCUMENTS

| | | | |
|---|---|---|---|
| 4,258,361 | 3/1981 | Hydes | 345/115 |
| 4,267,555 | 5/1981 | Boyd et al. | 345/126 |
| 4,542,377 | 9/1985 | Hagen et al. | 345/126 |
| 4,816,925 | 3/1989 | Hayashi | 345/126 |
| 4,831,368 | 5/1989 | Masimo et al. | 345/126 |
| 5,010,324 | 4/1991 | Yamamoto | 345/126 |
| 5,034,733 | 7/1991 | Okazawa et al. | 345/126 |
| 5,086,392 | 2/1992 | Nakajima | 345/115 |

*Primary Examiner*—Xiao Wu

*Attorney, Agent, or Firm*—Sughrue, Mion, Zinn, Macpeak & Seas, PLLC

[57] ABSTRACT

A document display device for displaying document pages thereof is provided. One or more document pages are displayed on an oblong or rectangular display face of turnable display having an oblong or rectangular display face and to be set to either vertical or horizontal position. The device comprises a face position setter for inputting therethrough an instruction for selectively setting the position of the display, and an image allocater instructing the number of document pages to be displayed on the display face of the display and also instructing to select the orientation of each document page.

2 Claims, 2 Drawing Sheets

DOCUMENT DISPLAY DEVICE

This is a Continuation of application Ser. No 08/123,067 filed Sep. 17, 1993, now abandoned.

BACKGROUND OF THE INVENTION

1. Field of the Invention

The present invention relates to a document display device for displaying one or more document pages on an oblong or rectangular display face of a rotatable display means which can be rotated from a vertical position to a horizontal position or vice versa.

2. Description of the Prior Art

There are known in the art an electronic filing system and a document editing or preparing system in which multiple documents are stored in a memory medium, such as optical disk, to be displayed on a display face of a display device. In such a system, it is a common practice to use display means, such as a liquid crystal display plate or cathode ray tube (CRT) having an oblong or rectangular display face.

In some of the known systems, the display means is rotatable between vertical and horizontal positions to put the image displaying area for the better accommodation to display the particular document page having a certain writing style, orientation and contour. The rotatable type of display means is advantageous in that the entire area of the display face of the display means can be more effectively used to display each page of the document in an enlarged condition. More specifically, when the document is oriented horizontally (i.e. the right and left sides of each document page are the shorter side with the longer sides being the top and bottom sides), the display face is rotated to and set in the horizontal position with its longitudinal side extending laterally or horizontally. On the contrary, when the document is oriented vertically, the display face is rotated to set in the vertical position with its longitudinal sides extending vertically.

However, in the prior art systems, when it is desired to display a document page having its longer sides extending in vertical lines on the display face set or held in the horizontal position, unavailed blank area is left around or aside the area occupied by the displayed page since only one page is displayed at one time on the display face. This leads a disadvantage that the display face is not fully used or availed to.

OBJECT AND SUMMARY OF THE INVENTION

Accordingly, the object of this invention is to provide a document display device comprising a display means having an oblong and rotatable display face and wherein the entire area of the display face can be used most effectively in both of the vertical and horizontal positions of the display means to assist the operator to search and edit or prepare a document more conveniently.

To attain the object mentioned above, the present invention provides a document display device for displaying one or more document pages at one time on an oblong display face of a rotatable display means which is rotatable between vertical and horizontal positions, comprising input means for inputting therethrough an instruction for selectively setting the position of said display means, and allocating means instructing the number of document pages to be displayed on the display face of said display means and also instructing to select the orientation of each document page.

In a preferred embodiment, the allocating means instructs to display two successive pages of the same document in the side by side or above and below relationship with each other.

BRIEF DESCRIPTION OF THE DRAWING

A more detailed understanding of the invention will be had by referring to the following description of the presently preferred embodiment thereof which is diagrammatically shown in the appended drawings, in which.

DESCRIPTION OF PREFERRED EMBODIMENT

A preferred embodiment of the invention will now be described with reference to the appended drawing.

Figure 1:
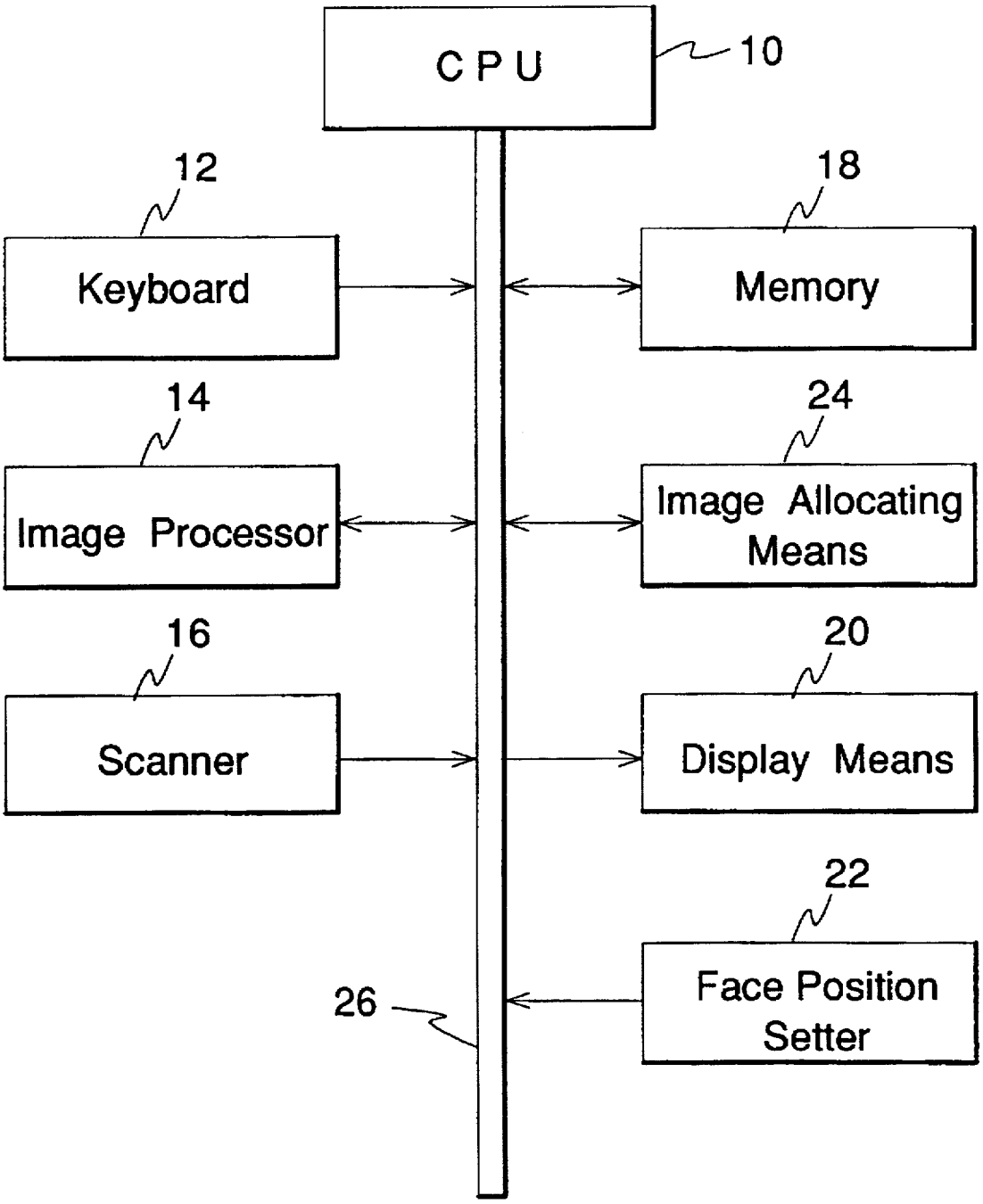
FIG. 1 is a block diagram showing an electronic filing system which is an embodiment of the invention.

In FIG. 1, the device embodying the invention comprises a central processing unit (CPU) 10, a keyboard 12, an image processor 14 and a scanner 16. Documents read by the scanner 16 and/or processed by the image processor 14 are stored in a memory 18. The memory 18 stores multiple documents and may be composed of an magneto-optical disk, a flopy disk, a semiconductor device or like proper memory medium. Operation programs for operating the CPU 10 and related peripheral units are also stored in the memory 18.

Figure 2A:
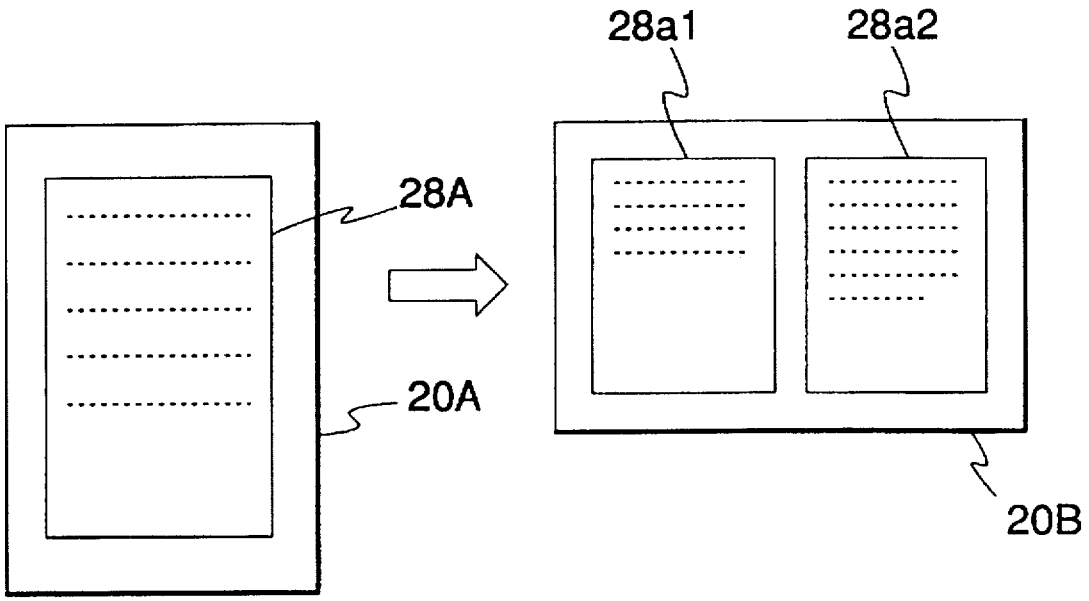
FIG. 2A is an illustration showing the display face set initially to the vertical position on which a single vertically-oriented page is displayed (see the left portion of FIG. 2A), and then rotated to the horizontal position to display two document pages thereon (see the right portion of FIG. 2A)
Figure 2B:
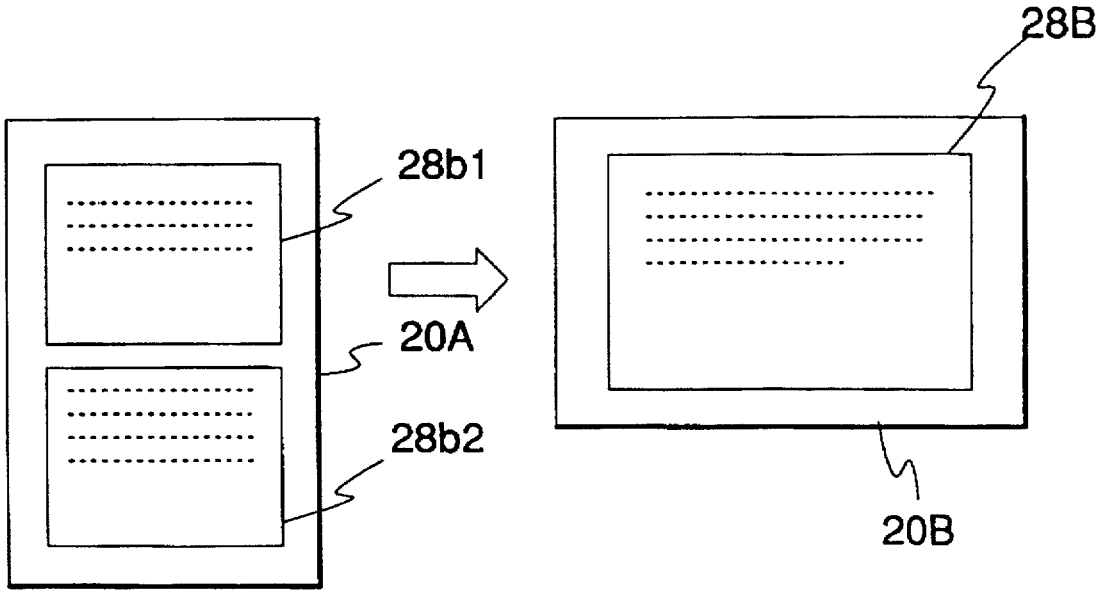
FIG. 2B is an illustration showing the display face initially set to the vertical position on which two horizontally-oriented pages are displayed (see the left portion of FIG. 2B), and then rotated to the horizontal position to display one of the two pages in an enlarged scale.

Reference numeral 20 designates display means which may be a liquid crystal display (LCD) plate, CRT or other proper display means and has a display face of generally oblong or rectangular contour or shape, as shown in FIGS. 2A and 2B. The display means 20 may be rotated between a vertical position 20A (where the longitudinal sides of the display face extend in the vertical direction) and a horizontal position 20B (where the longitudinal sides of the display face extend in the horizontal direction), as desired.

Input means for setting the position of the display face is denoted by 22, and may comprise a manually operable switch or a switch which automatically senses the position of the display means 20 by detecting the rotating angle of the display face of the means 20. When the input means 22 comprises a manually operable switch, one key on the keyboard 12 may be used as the input means 22. The input means will be referred to as "face position setter" in the appended drawing and some portions of the specification.

Image allocating means is denoted by 24. The image allocating means 24 determines or sets the number of document pages displayed on the display means 20 simultaneously at one time and the orientation of each displayed document page, and allocates each document page at proper location on the display face of the means 20. The CPU 10 is connected with the keyboard 12, the image processor 14, the scanner 16, the memory 18, the image allocating means 24, the display means 20 and the face position setter 22 through a bus 26, and performs a selected operation under the instructions of the corresponding operation program stored in and selected from the memory 18.

When a series of documents is read by the scanner 16, the images of respective document pages are stored in the memory 18. The image processor 14 processes the thus read images of respective document pages, examples of such processings performed through the image processor 14 including emphasis of the contour of each page and turning, enlargement and contraction of the image of each page. If a certain document is read by the scanner 16 in a condition where the letters are lying (in other words, laterally written passages in respective lines are aligned along vertical lines), an instruction is fed from the keyboard 12 through the CPU 10 to turn the entire page by 90 degrees so that the page displayed on the display face of the display means 20 is in an order to be read by the user.

In a searching operation in which a desired document is searched or selectively read from the memory, the target page is selected from the memory 18 under the instruction inputted from the keyboard 12 to be displayed by the display means 20. In this operation, the image allocating means 24 feeds instructions concerning the numbers and the orientation of the respective document pages so that the document pages are displayed on the display face of the display means 20 in a manner such that the area of the display face used for displaying purposes is as large as possible, in other words, such that the blank area on the display face left unused is as small as possible, as will be understood from the following description given by referring to FIGS. 2A and 2B.

For example, when the display means 20 is in the vertical position 20A with its longer sides extending vertically and it is desired to display one document page 28A on the display face, the image allocating means 24 generates an instruction to display the page in the vertical orientation so that the display face is fully occupied by that single page, as shown in the left portion of FIG. 2A. Otherwise, when it is desired to display another document which is oriented horizontally, two pages **28*b*1 and 28*b*2 are displayed simultaneously at one time on the display face, preferably in a manner such that the preceding page occupies the upper half and the subsequent page occupies the lower half of the display face, as shown in the left portion of FIG. 2B**.

On the other hand, provided that the display means 20 is turned to the horizontal position 20B as shown in the right portion of FIG. 2A and the document to be displayed is oriented vertically with its longer sides extending vertically similar to the document page 28A, an output signal or instruction is fed from the image allocating means 24 so that two pages **28*a*1, 28*a*2 (preferably two successive pages) of a document are displayed in the side by side relationship, while being contracted in size, as shown in the right portion in FIG. 2A. Otherwise, when the document is oriented horizontally with the longer sides extending in the horizontal lines and the display means 20 is turned to set the display face thereof to the horizontal position, one of the two pages, e.g. page 28*b*1, is displayed as the document page 28B in an enlarged condition as shown in the right portion of FIG. 2B**.

As will be easily understood by a skilled person or even by a person having ordinary knowledge, more than two pages may be displayed simultaneously at one time to use a entire available blank space or area of the display face of the display means 20, although two vertically-oriented pages have been displayed on the display face of the display means 20 held in the horizontal position (as shown in FIG. 2A) in the former example and two horizontally-oriented pages are displayed on the display face of the display means 20 held in the vertical position as shown in the latter example (as shown in FIG. 2B). When two or more pages of the same document are to be displayed, for example, to search a specific page or portion of the document, it is more preferable that the successive pages of the document are displayed simultaneously for convenience of searching or other requisite operations. Application of the device of the invention is not limited only to the electronic filing system described above, but may be applied to any other document editing or preparing devices. In such a case, it is often desired to display two document pages in a side by side (or above and below) relationship with each other, one of the two pages being the page which is currently being edited and the other being the page which has been edited or prepared during the preceding editing or preparation operation and stored in the memory 18.

As will be seen from the foregoing, according to this invention, the number of the document pages to be displayed simultaneously at one time on the display face and the orientation of each page to be displayed are changed to achieve the most effective use of the entire area of the display face in either case where the display means is turned between the vertical and horizontal position. A further advantage of the invention resides in that plural document pages can be displayed simultaneously at one time to make substantial full use of the display face to whichever position the display means is rotated, whereby editing operation can be performed more conveniently while viewing two or more document pages at the same time.

In a more preferable embodiment, the document pages thus displayed simultaneously at one time are successive pages of the same document to improve the operation efficiency in the editing or document preparing operation.

What is claimed is:

1. A document display device for displaying one or more oblong document pages on an oblong display face of a rotatable display means which is rotatable between vertical and horizontal positions, comprising:

input means for inputting an instruction for selectively setting the position of said display means; and image allocating means instructing selection of the number, orientation, and the size of said one or more document pages to be displayed on said display face;

wherein (a) when the document is oriented vertically with the longer sides extending vertically and said display face is set to the vertical position, the image data of one document page is displayed on said display face;

(b) when the document is oriented vertically with the longer sides extending vertically lines and said display face is set to the horizontal position, the image data of two document pages are respectively contracted in comparison with case (a) and displayed in the side by side condition;

(c) when the document is oriented horizontally with the longer sides extending horizontally lines and said display face is set to the horizontal position, the image data of one document page is displayed on said display face; and (d) when the document is oriented horizontally with the longer sides extending horizontally lines and said display face is set to the vertical position, the image data of two document pages are respectively contracted in comparison with case (c) and displayed in the above and below condition.

2. The document display device according to claim 1, wherein said image allocating means displays two successive pages of the same document in the event of case (b) or (d).

* * * * *